US011190870B2

(12) United States Patent
Johnson et al.

(10) Patent No.: US 11,190,870 B2
(45) **Date of Patent: *Nov. 30, 2021**

(54) ROTATIONALLY SYMMETRIC SPEAKER ARRAY

(71) Applicant: Apple Inc., Cupertino, CA (US)

(72) Inventors: Martin E. Johnson, Los Gatos, CA (US); Gordon R. Dix, Sunnyvale, CA (US); Michael B. Howes, San Jose, CA (US); Gary P. Geaves, Los Gatos, CA (US); Tom-Davy William Jendrik Saux, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/905,684

(22) Filed: Jun. 18, 2020

(65) Prior Publication Data

US 2020/0322718 A1 Oct. 8, 2020

Related U.S. Application Data

(63) Continuation of application No. 16/185,474, filed on Nov. 9, 2018, now Pat. No. 10,798,482, which is a (Continued)

(51) Int. Cl.
*H04R 5/02* (2006.01)
*H04R 1/40* (2006.01)

(52) U.S. Cl.
CPC ..... *H04R 1/403* (2013.01); *H04R 5/02* (2013.01); *H04R 2201/401* (2013.01)

(58) Field of Classification Search
CPC ..... H04R 1/025; H04R 1/24; H04R 1/403; H04R 3/13; H04R 5/02

(Continued)

(56) References Cited

U.S. PATENT DOCUMENTS 4,078,155 A * 3/1978 Botros ..... H04M 1/62 379/369
4,270,023 A * 5/1981 Beveridge ..... H04R 1/26 381/191

(Continued)

FOREIGN PATENT DOCUMENTS

| | | |
|---|---|---|
| CN | 102196334 A | 9/2011 |
| DE | 868921 | 3/1953 |
| EP | 0762801 A2 | 12/1997 |

OTHER PUBLICATIONS

Article 94(3) EPC for European Application No. 14758234.0 mailed Jun. 9, 2020, 12 pages.

(Continued)

*Primary Examiner* — Melur Ramakrishnaiah
(74) *Attorney, Agent, or Firm* — Womble Bond Dickinson (US) LLP

(57) ABSTRACT

A multi-way speaker array is disclosed that includes rings of transducers of different types. The rings of transducers may encircle the cabinet of the speaker array such that the speaker array is rotationally symmetric. The distance between rings of transducers may be based on a logarithmic scale. By separating rings of transducers using logarithmic spacing, denser transducer spacing at short wavelengths is achieved while limiting the number of transducers needed for longer wavelengths by spacing them in larger and larger logarithmic increments. Transducers with overlapping frequency ranges may be used in the speaker array to avoid initial dips or shortfalls in directivity for corresponding beam patterns.

19 Claims, 20 Drawing Sheets

Related U.S. Application Data continuation of application No. 15/583,949, filed on May 1, 2017, now Pat. No. 10,154,339, which is a continuation of application No. 15/504,312, filed as application No. PCT/US2014/051554 on Aug. 18, 2014, now Pat. No. 10,149,046.

(58) Field of Classification Search
USPC ..... 381/335, 336, 300, 302, 303, 305, 306, 381/307
See application file for complete search history.

(56) References Cited

U.S. PATENT DOCUMENTS

| | | | | |
|---|---|---|---|---|
| 6,128,395 | A | 10/2000 | De Vries | |
| 9,900,723 | B1 * | 2/2018 | Choisel | H04S 7/305 |
| 2007/0269071 | A1 * | 11/2007 | Hooley | H04R 3/12 381/336 |
| 2016/0021480 | A1 * | 1/2016 | Johnson | H04R 5/04 381/300 |

OTHER PUBLICATIONS

Chinese Office Action and translation for CN Patent Application No. 201911352125.X dated Dec. 30, 2020 (19 pages).

* cited by examiner

ROTATIONALLY SYMMETRIC SPEAKER ARRAY

CROSS-REFERENCE TO RELATED APPLICATIONS

This patent application is a continuation application of U.S. patent application Ser. No. 16/185,474, filed Nov. 9, 2018, entitled ROTATIONALLY SYMMETRIC SPEAKER ARRAY, which is a continuation application of U.S. patent application Ser. No. 15/583,949, filed May 1, 2017, entitled A ROTATIONALLY SYMMETRIC SPEAKER ARRAY, now issued as U.S. Pat. No. 10,154,339, which is a continuation application of U.S. patent application Ser. No. 15/504,312, filed Feb. 15, 2017, now issued as U.S. Pat. No. 10,149,046, which is a U.S. National Phase Application under 35 U.S.C. 371 of International Application No. PCT/US2014/051554, filed Aug. 18, 2014.

FIELD

A rotationally symmetric speaker array, which includes multiple types of transducers symmetrically arranged in rings around an enclosure is disclosed. Other embodiments are also described.

BACKGROUND

Speaker arrays are often used by computers and home electronics for outputting sound into a listening area. Each speaker array may be composed of multiple transducers that are arranged on a single plane or surface or an associated cabinet or casing. Since the transducers are arranged on a single surface, these speaker arrays must be manually oriented such that sound produced by each array is aimed at a particular target (e.g., a listener). For example, a speaker array may be initially oriented to directly face a listener. However, any movement of the speaker array and/or the listener may require manual adjustment of the array such that generated sound is again properly aimed at the target listener. This repeated adjustment and configuration may become time consuming and may provide a poor user experience.

SUMMARY

A multi-way speaker array is disclosed that includes one or more rings or transducers of different types. In one embodiment, the rings or transducers encircle the cabinet of the speaker array such that the speaker array is rotationally symmetric. This rotational symmetry allows the speaker array to be easily adapted to any placement within the listening area. In particular, since the speaker array is rotationally symmetric, the same number and type of transducer are pointed in each direction. Once the orientation of the speaker array is known, the speaker array may be driven according to this orientation to produce one or more channels or audio without the need for movement and/or physical adjustment of the speaker array.

In some embodiments, the distance between rings of transducers may be based on a logarithmic scale. By separating rings of transducers using logarithmic spacing, denser transducer spacing at short wavelengths is achieved while limiting the number of transducers needed for longer wavelengths by spacing them in larger and larger logarithmic increments.

In one embodiment, the selection of types of transducers may be made based on desired frequency coverage for the speaker array. In some embodiments, the frequency ranges covered by separate types of transducers may overlap. In these embodiments, multiple types of transducers may be used to generate beam patterns. By utilizing multiple transducers with overlapping frequency ranges, the speaker array may avoid initial dips or shortfalls in directivity for corresponding beam patterns.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
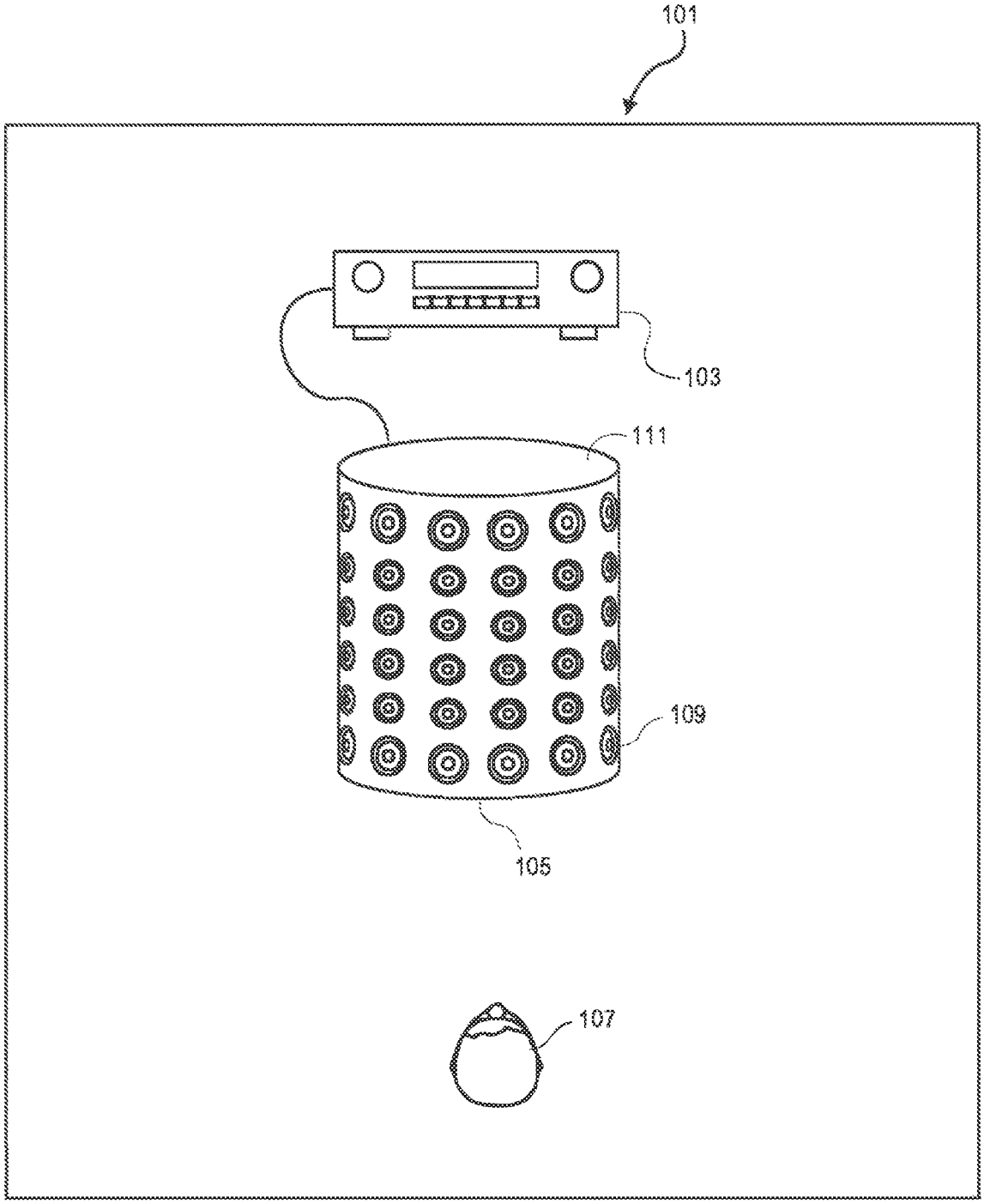
FIG. 1 shows a view of a listening area with an audio receiver, a rotationally symmetric speaker array, and a listener according to one embodiment.

FIG. 1 shows a view of a listening area 101 with an audio receiver 103, a rotationally symmetric speaker array 105, and a listener 107. The audio receiver 103 may be coupled to the speaker array 105 to drive individual transducers 109 in the speaker array 105 to emit various sound beam patterns into the listening area 101. In one embodiment, the speaker array 105 may be configured to generate beam patterns that represent individual channels of a piece of sound program content. For example, the speaker array 105 may generate beam patterns that represent front left, front right, and front center channels or a piece of sound program content (e.g., a musical composition or an audio track for a movie).

Figure 2A:
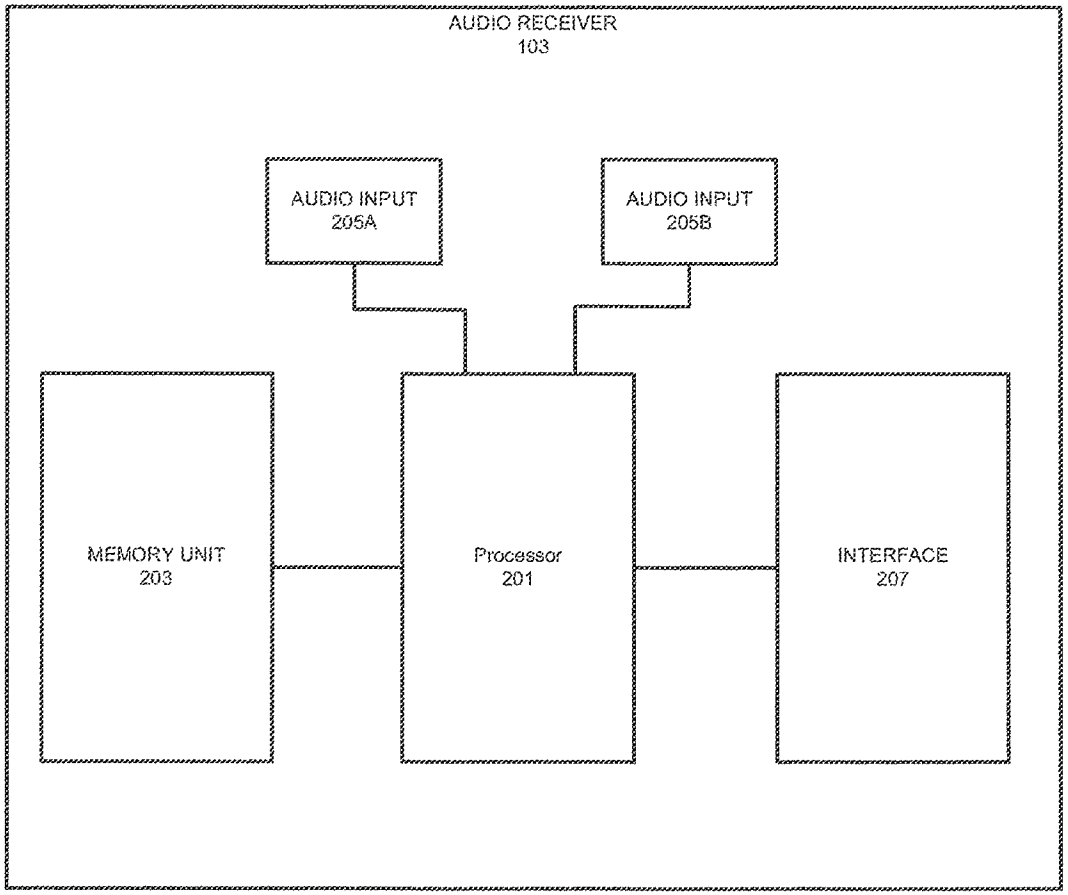
FIG. 2A shows a component diagram of the audio receiver according to one embodiment.

FIG. 2A shows a component diagram of the audio receiver 103 according to one embodiment. The audio receiver 103 may be any electronic device that is capable of driving one or more transducers 109 in the speaker array 105. For example, the audio receiver 103 may be a desktop computer, a laptop computer, a tablet computer, a home theater receiver, a set-top box, and/or a mobile device (e.g., a smartphone). The audio receiver 103 may include a hardware processor 201 and a memory unit 203.

The processor 201 and the memory unit 203 are generically used here to refer to any suitable combination of programmable data processing components and data storage that conduct the operations needed to implement the various functions and operations of the audio receiver 103. The processor 201 may be an applications processor typically found in a smart phone, while the memory unit 203 may refer to microelectronic, non-volatile random access memory. An operating system may be stored in the memory unit 203 along with application programs specific to the various functions of the audio receiver 103, which are to be run or executed by the processor 201 to perform the various functions of the audio receiver 103.

The audio receiver 103 may include one or more audio inputs 205 for receiving audio signals from an external and/or a remote device. For example, the audio receiver 103 may receive audio signals from a streaming media service and/or a remote server. The audio signals may represent one or more channels of a piece of sound program content (e.g., a musical composition or an audio track for a movie). For example, a single signal corresponding to a single channel of a piece of multichannel sound program content may be received by an input 205 of the audio receiver 103. In another example, a single signal may correspond to multiple channels of a piece of sound program content, which are multiplexed onto the single signal.

In one embodiment, the audio receiver 103 may include a digital audio input 205A that receives digital audio signals from an external device and/or a remote device. For example, the audio input 205A may be a TOSLINK connector or a digital wireless interface (e.g., a wireless local area network (WLAN) adapter or a Bluetooth receiver). In one embodiment, the audio receiver 103 may include an analog audio input 205B that receives analog audio signals from an external device. For example, the audio input 205B may be a binding post, a Fahnestock clip, or a phono plug that is designed to receive a wire or conduit and a corresponding analog signal.

In one embodiment, the audio receiver 103 may include an interface 207 for communicating with the speaker array 105. The interface 207 may utilize wired mediums (e.g., conduit or wire) to communicate with the speaker array 105, as shown in FIG. 1. In another embodiment, the interface 207 may communicate with the speaker array 105 through a wireless connection. For example, the network interface 207 may utilize one or more wireless protocols and standards for communicating with the speaker array 105, including the IEEE 802.11 suite of standards, IEEE 802.3, cellular Global System for Mobile Communications (GSM) standards, cellular Code Division Multiple Access (CDMA) standards. Long Term Evolution (LTE) standards, and/or Bluetooth standards.

Figure 2B:
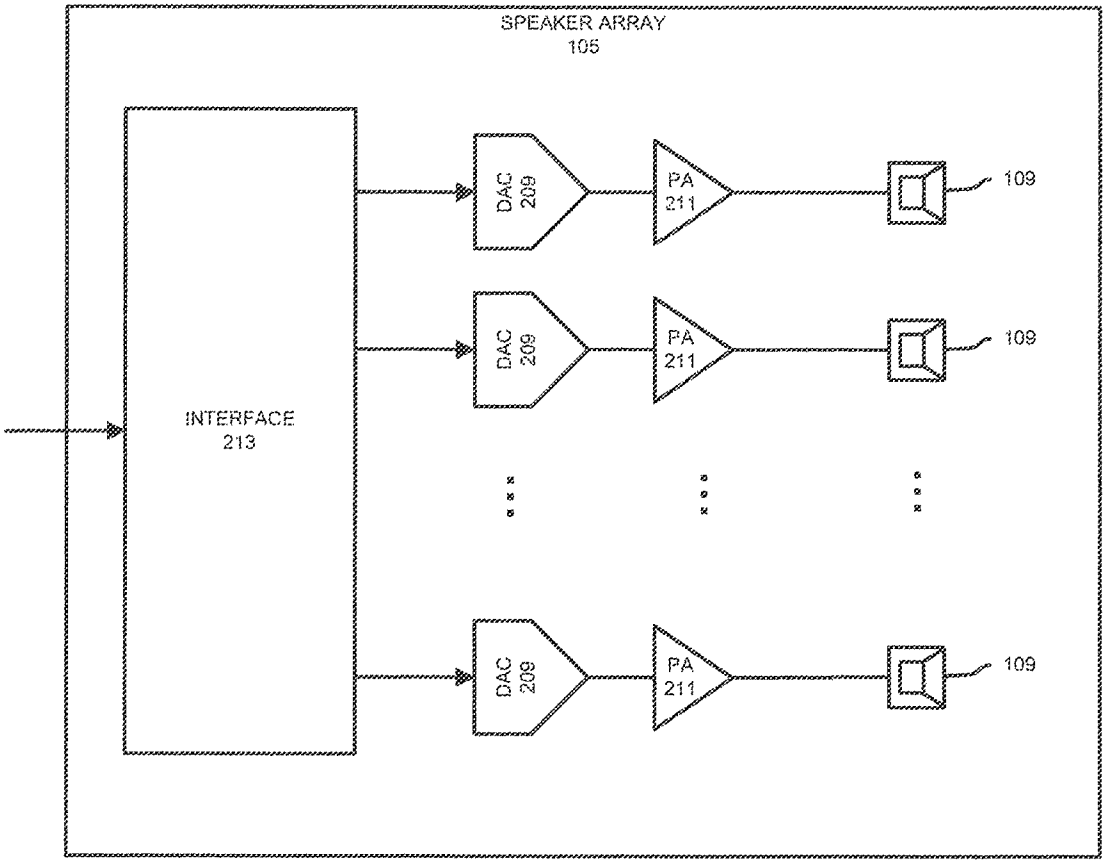
FIG. 2B shows a component diagram and signal flow in the speaker array according to one embodiment.

As shown in FIG. 2B, the speaker array 105 may receive drive signals from the audio receiver 103 and drive each of the transducers 109 in the array 105 through a corresponding interface 213. As with the interface 207, the interface 213 may utilize wired protocols and standards and/or one or more wireless protocols and standards, including the IEEE 802.11 suite of standards, IEEE 802.3, cellular Global System for Mobile Communications (GSM) standards, cellular Code Division Multiple Access (CDMA) standards. Long Term Evolution (LTE) standards, and/or Bluetooth standards. In some embodiment, the speaker array 105 may include digital-to-analog converters 209 and power amplifiers 211 for driving each transducer 109 in the speaker array 105.

Although described and shown as being separate from the audio receiver 103, in some embodiments, one or more components of the audio receiver 103 may be integrated within the speaker array 105. For example, the speaker array 105 may include the hardware processor 201, the memory unit 203, and the one or more audio inputs 205.

As shown in FIG. 1, the speaker array 105 houses multiple transducers 109 in a curved cabinet 111. As shown, the cabinet 111 is cylindrical; however, in other embodiments the cabinet may be in any shape, including a polyhedron, a frustum, a cone, a pyramid, a triangular prism, a hexagonal prism, a sphere, or a frusto conical shape.

Figure 3:
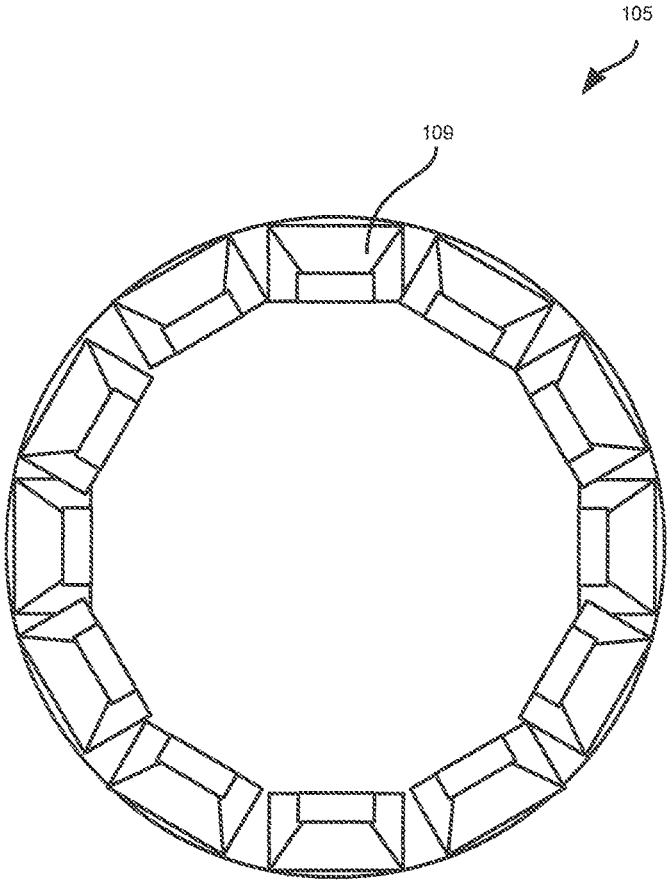
FIG. 3 shows an overhead, cutaway view of the speaker array according to one embodiment.

FIG. 3 shows an overhead, cutaway view of the speaker array 105. As shown in FIGS. 1 and 3, the transducers 109 in the speaker array 105 encircle the cabinet 111 such that transducers 109 cover the curved face of the cabinet 111. The transducers 109 may be any combination of full-range drivers, mid-range drivers, subwoofers, woofers, and tweeters. Each of the transducers 109 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 109 magnetic system interact, generating a mechanical force that causes the coil (and thus, the attached cone) to move back and forth, thereby reproducing sound under the control of the applied electrical audio signal coming from an audio source, such as the audio receiver 103. Although electromagnetic dynamic loudspeaker drivers are described for use as the transducers 109, those skilled in the art will recognize that other types of loudspeaker drivers, such as piezoelectric, planar electromagnetic and electrostatic drivers are possible.

Figure 4:
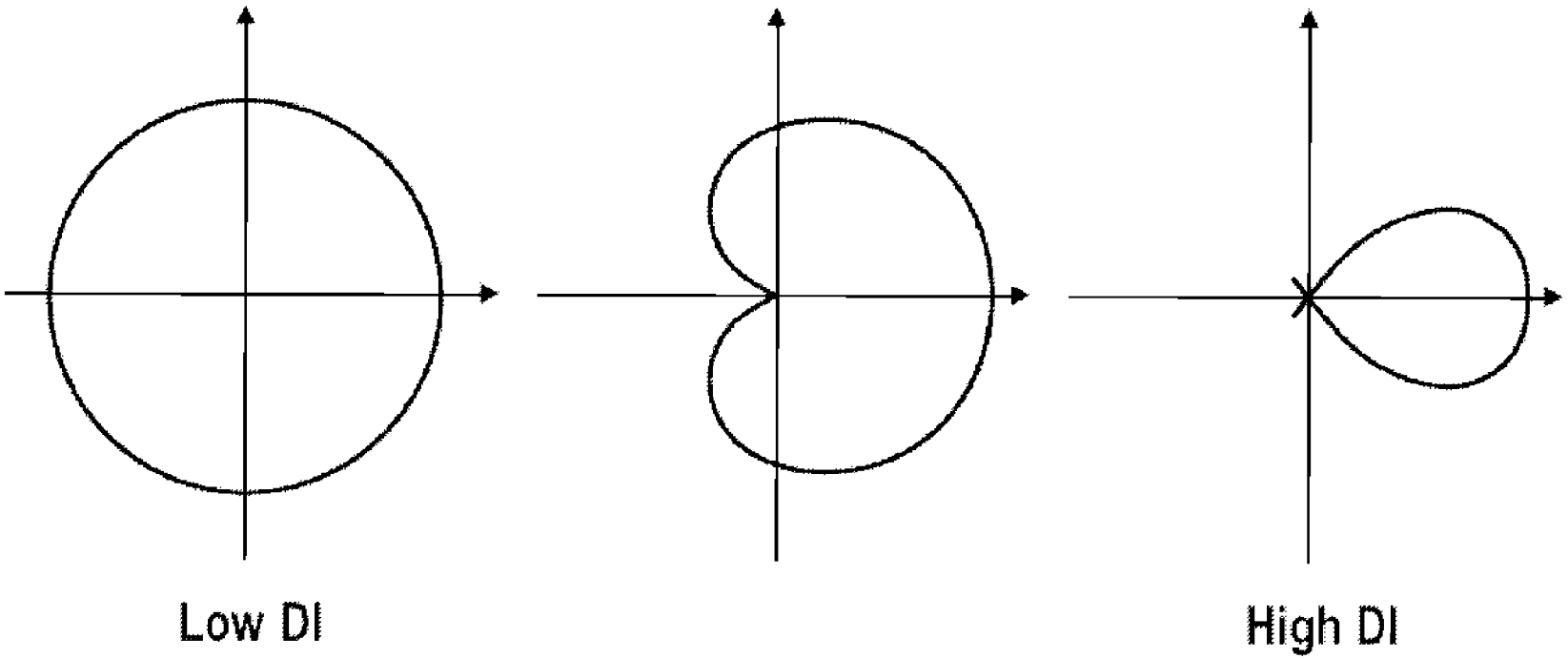
FIG. 4 shows example beam patterns with varied directivity indices (DIs) that may be generated by the speaker array according to one embodiment.

Each transducer 109 may be individually and separately driven to produce sound in response to separate and discrete audio signals received from an audio source (e.g., the audio receiver 103). By allowing the transducers 109 in the speaker array 105 to be individually and separately driven according to different parameters and settings (including delays and energy levels), the speaker array 105 may produce numerous directivity/beam patterns that accurately represent each channel of a piece of sound program content output by the audio receiver 103. For example, in one embodiment, the speaker array 105 may produce one or more of the directivity patterns shown in FIG. 4. The directivity patterns produced by the speaker array 105 may not only differ in shape, but may also differ in direction. For example, a directivity pattern may be adjusted to point in various directions in the listening area 101 and/or different directivity patterns may be pointed in different directions.

Figure 5A:
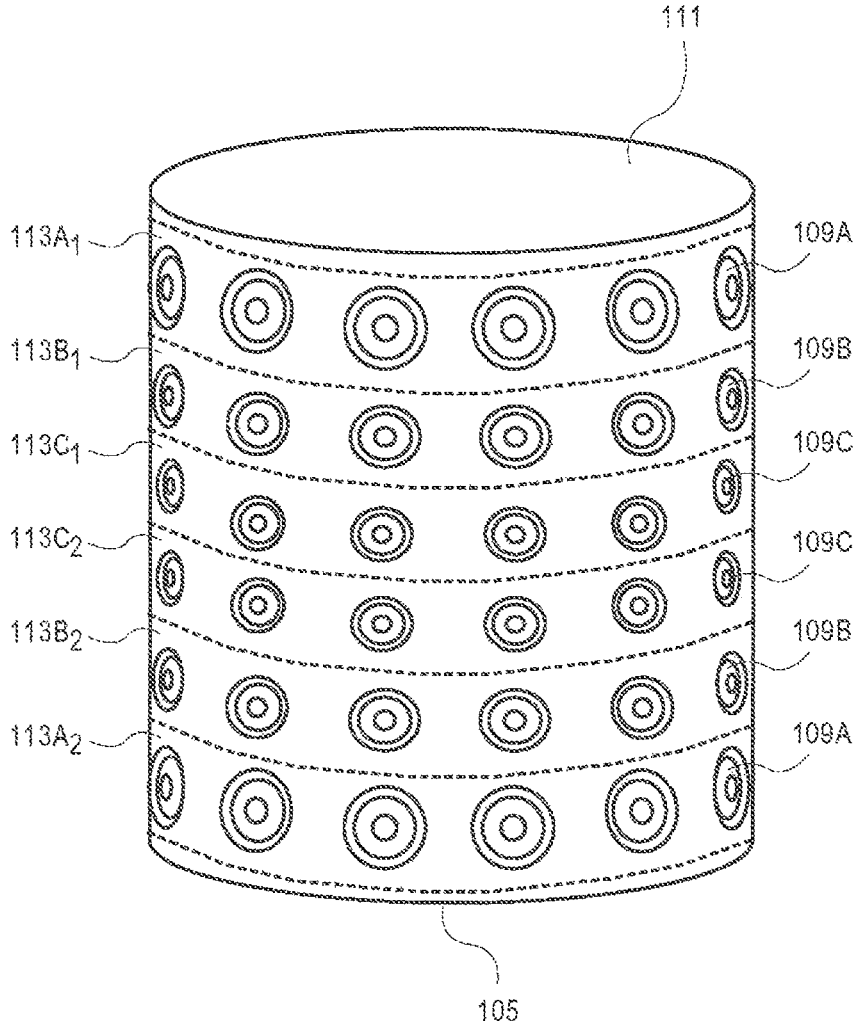
FIG. 5A shows a view of the speaker array with two rings of transducers of a first type, two rings of transducers of a second type, and two rings of transducers of a third type according to one embodiment.

In one embodiment, the speaker array 105 may include multiple types of transducers 109 aligned in rings 113 around the cabinet 111 as shown in FIG. 5A. The different types of transducers 109 may be selected based on sound frequencies intended to be used by each transducer 109. For example, the speaker array 105 shown in FIG. 5A may include three separate types of transducers 109A-109C arranged in groups of rings 113. In this example, the transducers 109A in the rings 113$A_1$ and 113$A_2$ may be selected to ideally play low-frequency sounds (e.g., sounds in the range of 20 Hz to 200 Hz); the transducers 109B in the rings 113$B_1$ and 113$B_2$ may be selected to ideally play mid-frequency sounds (e.g., sounds in the range of 201 Hz to 2,000 Hz) and the transducers 109C in the rings 113$C_1$ and 113$C_2$ may be selected to ideally play high-frequency sounds (e.g., sounds in the range of 2,001 Hz to 20,000 Hz). A set of crossover filters may be used within the speaker array 105 for splitting an audio signal into separate frequency bands and driving each type of transducer 109 with a corresponding band. Although the example frequency ranges provided above are non-overlapping between the different types of transducers 109A-109C, in other embodiments, as will be described below, the frequency ranges of the different types of transducers 109A-109C within the speaker array 105 may be overlapping.

Figure 5B:
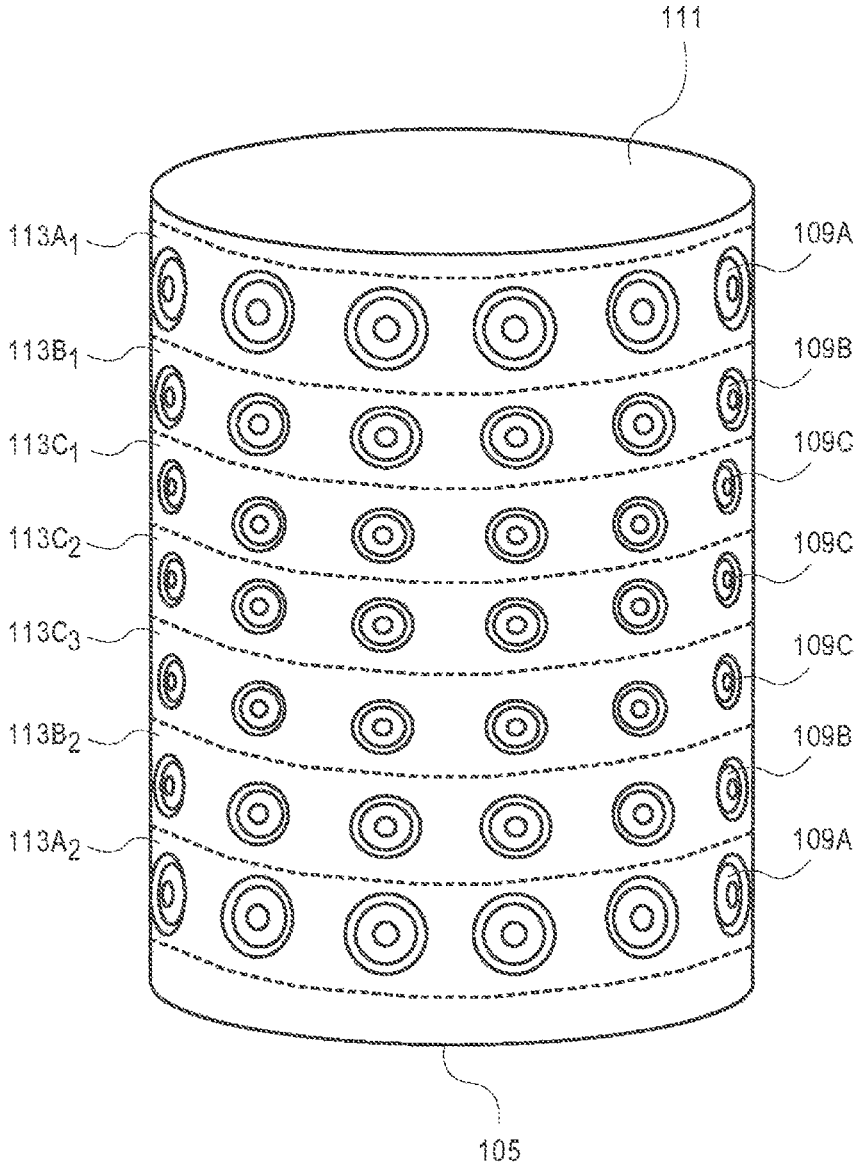
FIG. 5B shows a view of the speaker array with two rings of transducers of a first type, two rings of transducers of a second type, and three rings of transducers of a third type according to one embodiment.
Figure 5C:
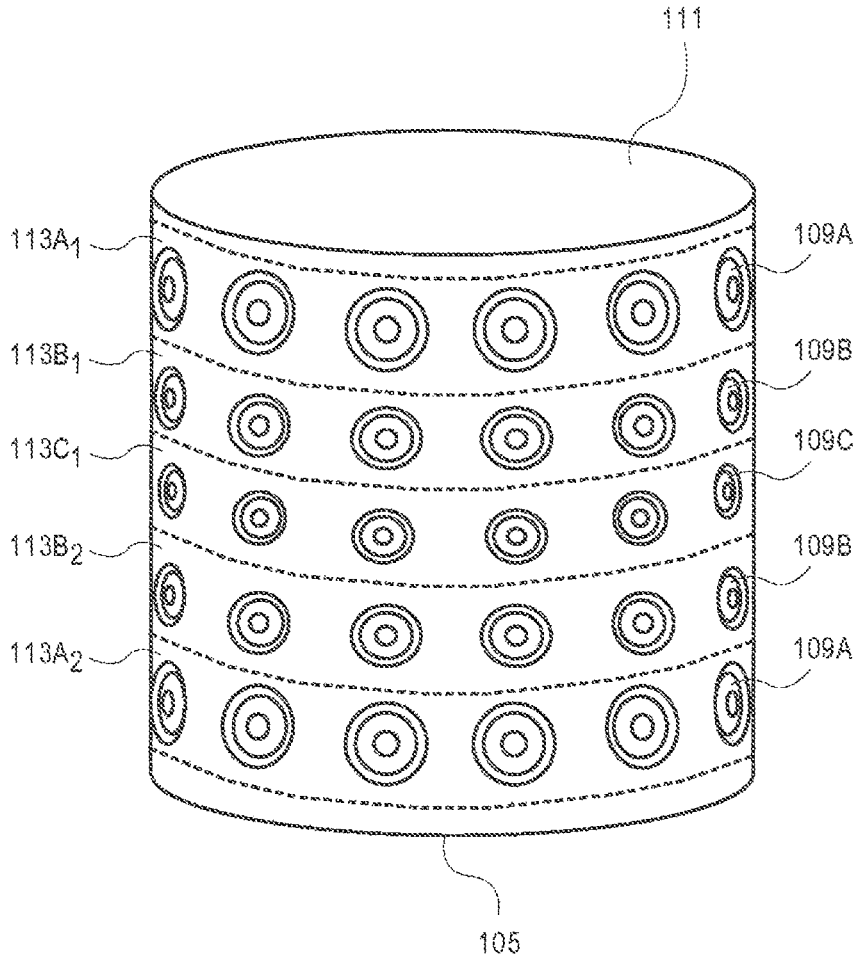
FIG. 5C shows a view of the speaker array with two rings of transducers of a first type, two rings of transducers of a second type, and one ring of transducers of a third type according to one embodiment.

As shown in FIG. 5A and described above, each of the transducers 109 are arranged in rings 113 based on type. For instance, the transducers 109A may be arranged in two outer rings 113$A_1$ and 113$A_2$, the transducers 109B may be arranged in two rings 113$B_1$ and 113$B_2$ between the rings 113$A_1$ and 113$A_2$, and the transducers 109C may be arranged in two rings 113$C_1$ and 113$C_2$ between the rings 113$B_1$ and 113$B_2$. In other embodiments, the configuration of the transducers 109 may be different. For example, as shown in FIG. 5B, the speaker array 105 may include three rings 113$C_1$, 113$C_2$, and 113$C_3$ of the transducers 109C. In another example embodiment shown in FIG. 5C, the speaker array 105 may include a single ring 113$C_1$ of the transducers 109C.

In one embodiment, the number of rings 113 and type of transducers 109 in each ring 113 maintains horizontal symmetry for the speaker array 105 about a horizontal axis. In this embodiment, there are an even number of outer rings 113 of each type that symmetrically surround more inner rings 113. For example, in FIG. 5C there are an even number of rings 113A that surround the more inner rings 113B and 113C. Similarly, there are an even number of rings 113B that surround the ring 113C. The speaker arrays 105 shown in FIGS. 5A and 5C maintain similar symmetry about a horizontal access through the center of the array 105. By maintaining horizontal symmetry in this fashion, the speaker array 105 allows sound produced from each type of transducer 109 and each frequency of sound produced by this complimentary arrangement of transducers 109 to appear to originate from the same origin point. In particular, since low frequency sounds may be produced from the transducers 109A in the ring 113$A_1$ and the transducers 109A in the ring 113$A_2$, these low frequency sounds will appear to emanate from the center of the speaker array 105 instead of from a top or bottom portion of the speaker array. Similarly, mid and high frequency sounds produced by the transducers 109B and 109C, respectively, will also appear to emanate from the center of the speaker array 105 based on this horizontal symmetry.

Figure 6A:
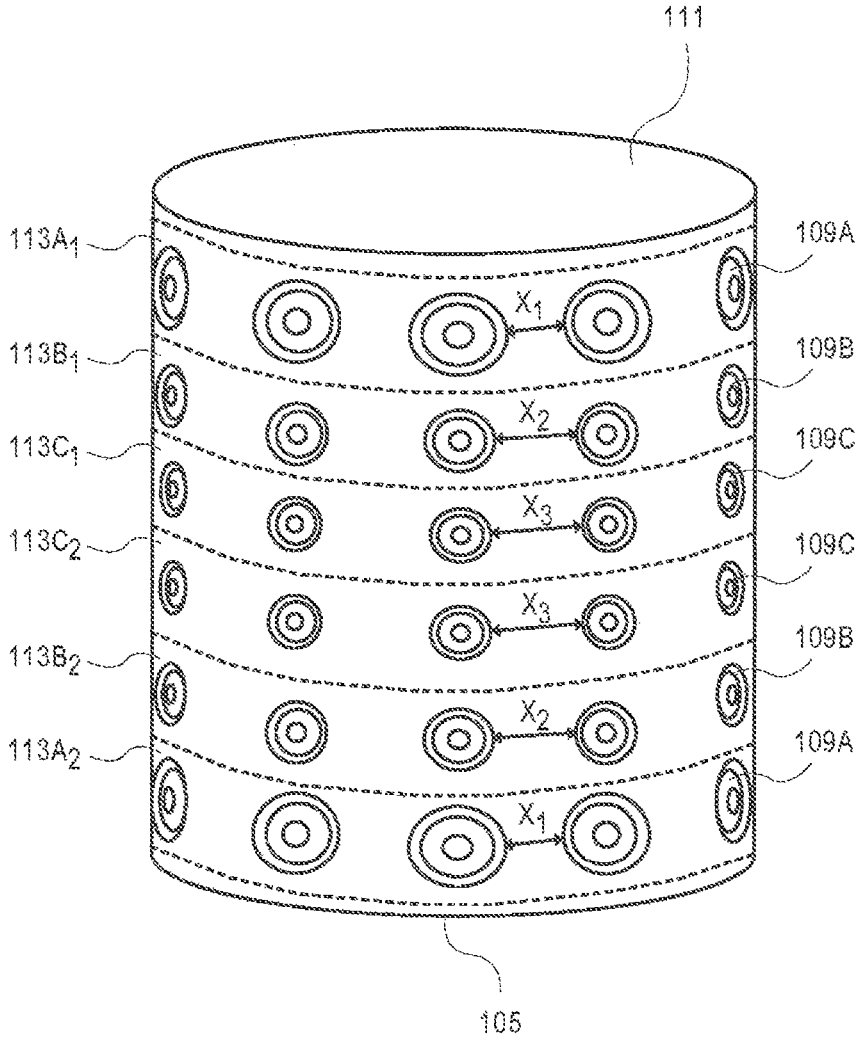
FIG. 6A shows the distance between transducers within a ring according to one embodiment.

In one embodiment, each transducer 109 in each ring 113 may be evenly spaced relative to adjacent transducers 109 in the same ring 113. For example, as shown in FIG. 6A, the distance between the outer rim of adjacent transducers 109A in the rings 113$A_1$ and 113$A_2$ may be $X_1$, the distance between the outer rim of each of adjacent transducers 109B in the rings 113$B_1$ and 113$B_2$ may be $X_2$, and the distance between the outer rim of adjacent transducers 109C in the rings 113$C_1$ and 113$C_2$ may be $X_3$. In this embodiment, each transducer 109 is evenly spaced relative to each other transducer 109 in a corresponding ring 113. However, since the diameters of each of the different types of transducers 109A-109C may be different, the distance between each type of transducer 109A-109C may also be different (i.e., $X_1/X_2/X_3$).

Although described and shown in relation to multiple rings 113, in some embodiments, the speaker array 105 may include a single ring 113 of transducers 109. In this embodiment, the single ring 113 of transducers 109 may be of a single type.

Although shown as including the same number of transducers 109 in each of the rings 113, in some embodiments the number of transducer 109 in each ring 113 may be different/not constant. For example, in an embodiment in which a speaker array 105 has rings 113 with different types of transducers 109, the number of transducers 100 in each ring 113 may be different. More specifically, in a speaker array 105 with rings 113$A_1$ and 113$A_2$ with transducers 109A, rings 113$B_1$ and 113$B_2$ with transducers 109B, and rings 113$C_1$ and 113$C_2$ with transducers 109C, the number of transducers 109C in the rings 113$C_1$ and 113$C_2$ may be greater than the number of transducers 109B in the rings 113$B_1$ and 113$B_2$. Further, the number of transducers 109B in the rings 113$B_1$ and 113$B_2$ may be greater than the number of transducers 109A in the rings 113$A_1$ and 113$A_2$. This difference in the number of transducers 109 in each ring 113 may accommodate the difference in diameter of each type of transducer 109.

Figure 6B:
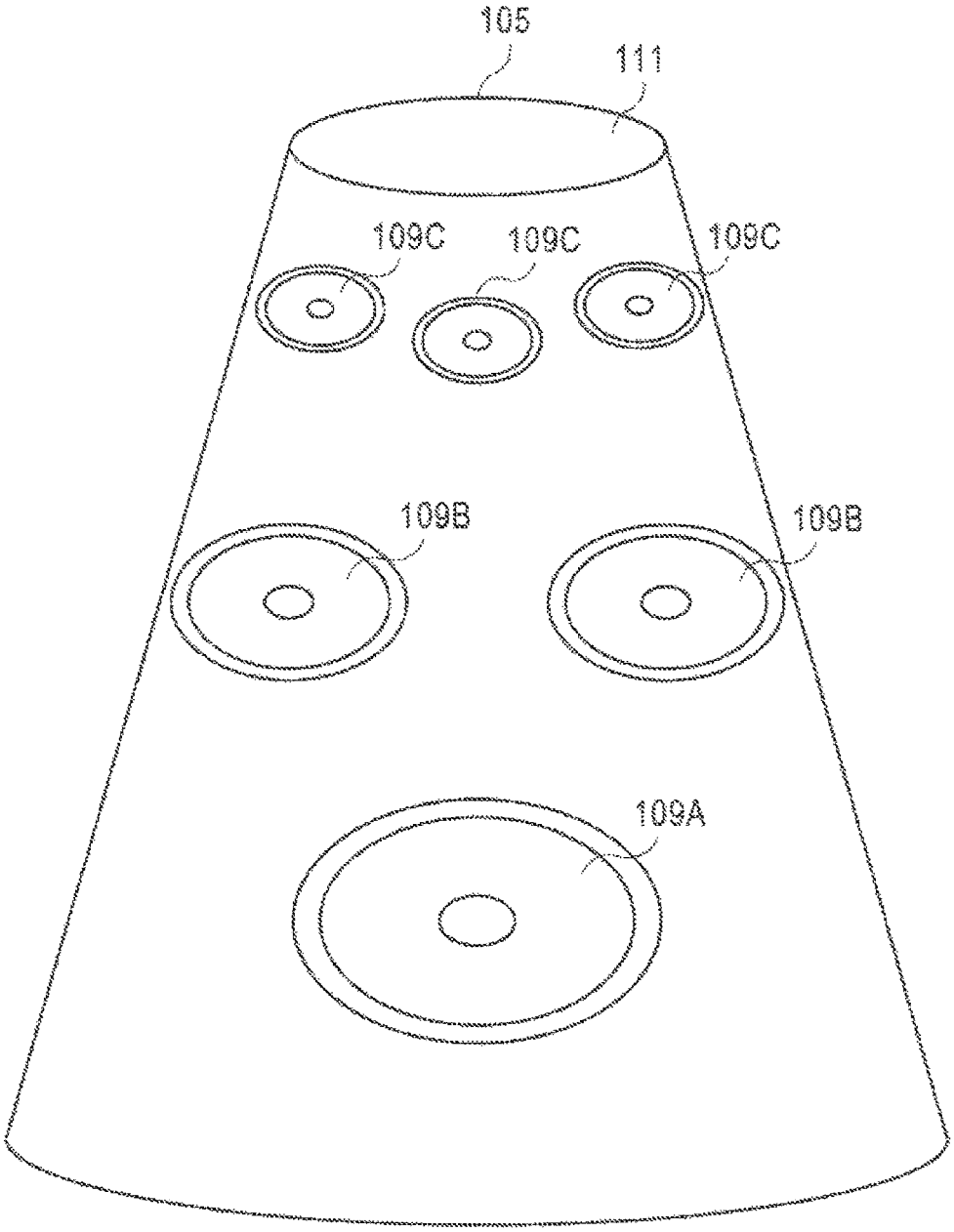
FIG. 6B shows transducer placement in a speaker array with a conically shaped cabinet according to one embodiment.

In some embodiments, the number of transducers 109 in each ring 113 may be constant even when the diameters of the different types or transducers 109 in each ring are different. For example, in some embodiments, a speaker array 105 with a cabinet 111 having a conical shape may be used. In this embodiment, the larger transducers 109 may be placed at the bottom of the conically shaped cabinet 11 while the smaller transducers 109 may be placed at the top of the conically shaped cabinet 111 as shown in FIG. 6B.

Figure 7A:
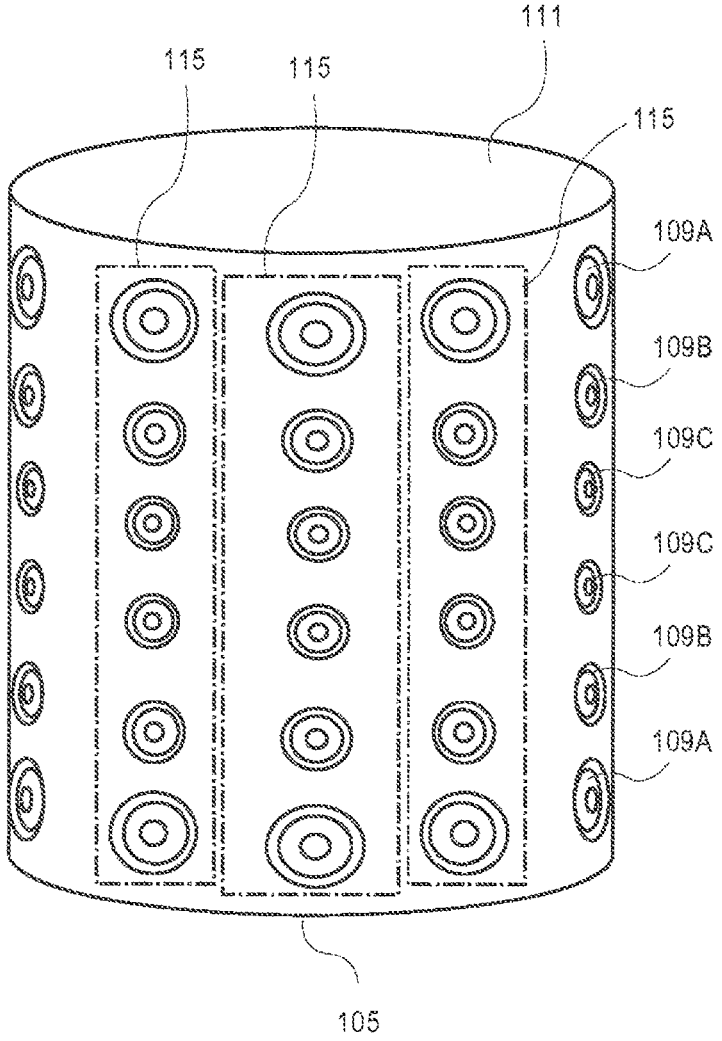
FIG. 7A shows transducers arranged in uniform columns according to one embodiment.

In one embodiment, transducers 109 between rings 113 may be evenly aligned as shown in FIGS. 5A-5C and FIG. 7A. In this embodiments, as shown in FIG. 7A, the centers of each transducer 109 are aligned with the centers of transducers 109 in other rings 113 to form uniform columns 115 of transducers 109. The uniform columns 115 of transducers 109 may encircle the cabinet 111 of the speaker array 105. Based on this configuration, the number of uniform columns 115 is equal to the number of transducers 109 in any ring 113 within the speaker array 105.

Figure 7B:
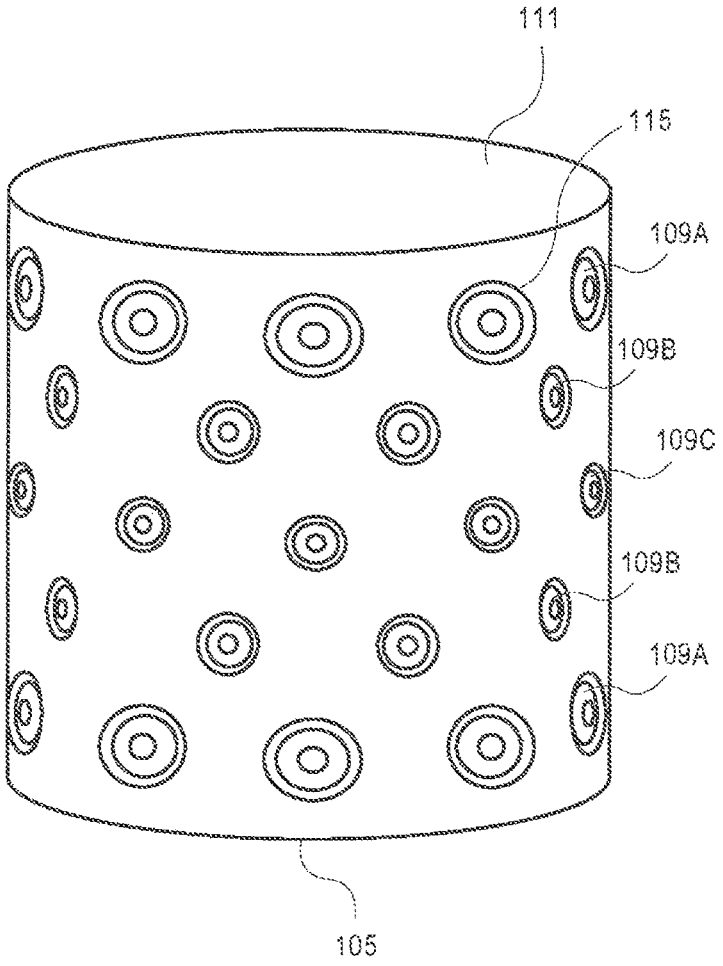
FIG. 7B shows transducers offset between rings according to one embodiment.

In other embodiments, the separate rings 113 of transducers 109 may be offset from adjacent rings 113 as shown in FIG. 7B. In these embodiments, the center of each transducer 109 in the speaker array 105 is aligned directly between transducers 109 in adjacent rings 113. For example, as shown in FIG. 7B, the transducers 109A and 109C are aligned between the transducers 109B and consequently the transducers 109B are aligned between the transducers 109A and 109C.

Figure 8:
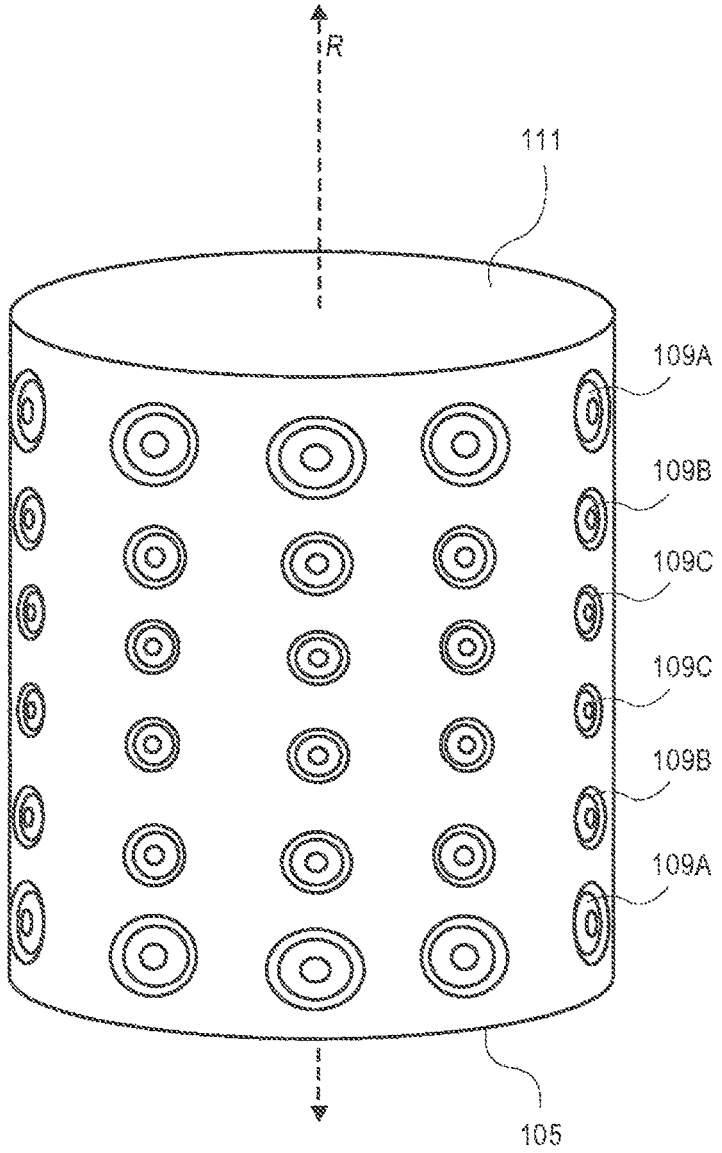
FIG. 8 shows the speaker array rotationally symmetric about a center axis according to one embodiment.

Using the configurations discussed above, the speaker array 105 is rotationally symmetric about the center axis R as shown in FIG. 8 such that rotating the speaker array 105 around the axis R a prescribed amount/degree does not change how the speaker array 105 looks relative to a defined perspective. For example, the speaker array 105 may be rotationally symmetric on the order of N, where N is the number of transducers 109 in each ring 113 of transducer 109. By the speaker array 105 being rotationally symmetric on the order of N, rotating the speaker array 105 about the axis R at an angle of 360/n, where n is an integer between 1 and N, does not change how the speaker array 105 looks relative to a defined perspective.

This rotational symmetry allows the speaker array 105 to be easily adapted to any placement within the listening area 101. For example, the speaker array 105 may be associated with one or more sensors and logic circuits for detecting the orientation of the speaker array 105 relative to the listener 107 and/or one or more objects in the listening area 101 (e.g., walls in the listening area 101). For instance, the sensors may include microphones, cameras, accelerometers, or other similar devices. These sensors and logic circuits may be integrated with the speaker array 105 and/or separate from the array 105 (e.g., the sensors and logic circuits may be within or coupled to the audio receiver 103). For example, one or more transducers 109 in the speaker array 105 may be driven to output a series of test sounds into the listening area 101. These test sounds may be detected by a set of microphones within the listening area 101. Based on the detected sounds, the orientation of the speaker array 105 may be determined relative to one or more of the microphones, the listener 107, and/or one or more objects in the listening area 101. Since the speaker array 105 is rotationally symmetric, the same number and type of transducers 109 are pointed in all directions. Accordingly, once the orientation of the speaker array 105 is known, the speaker array 105 may be driven according to this orientation to produce one or more channels of audio without the need for movement and/or physical adjustment of the speaker array 105.

Figure 9:
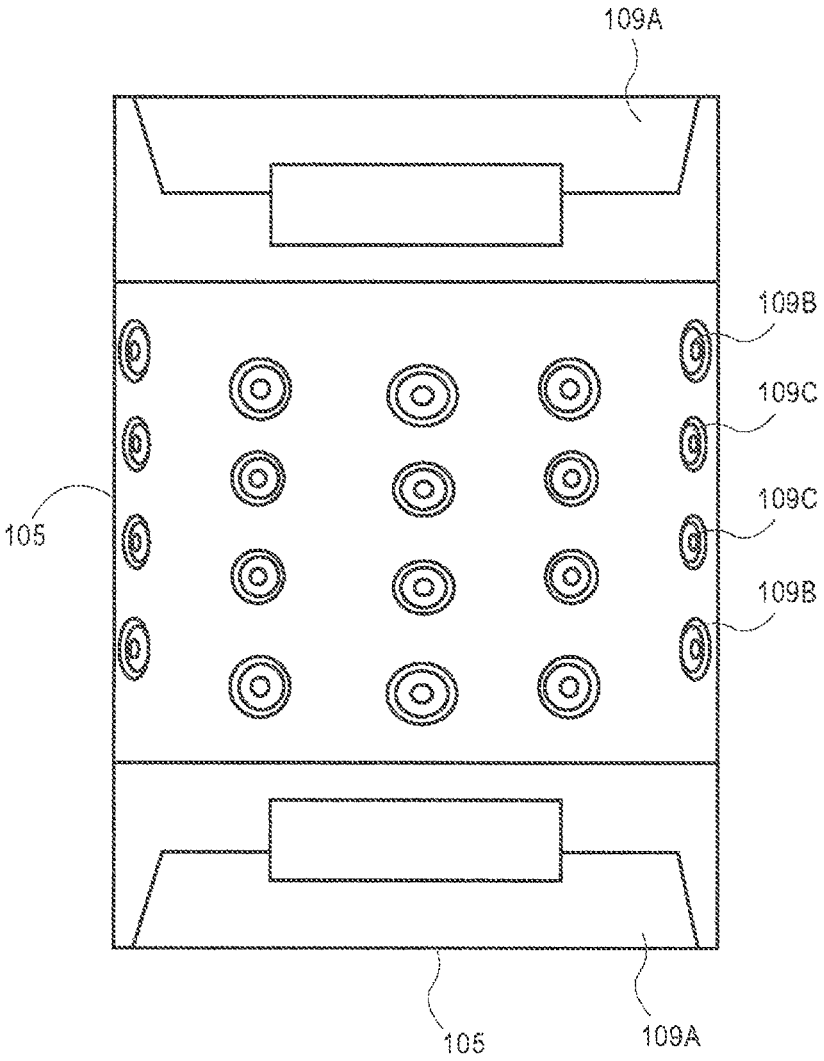
FIG. 9 shows a set of transducers of a first type arranged on the top and bottom surface of the cabinet and perpendicular to a set of transducers of a second type and a set of transducers of a third type according to one embodiment.

Although described above and shown in FIGS. 5A-5C as each transducer 109 located in a ring around the cabinet 111 of the speaker array 105, in some embodiments one or more of the transducers 109 may be placed on top and/or bottoms surfaces of the cabinet 111. For example, as shown in FIG. 9, the transducers 109A may be respectively placed on the top and bottom surfaces of the cabinet 111 and faced outward relative to the cabinet 111. In this configuration, the transducers 109A are faced perpendicular to the transducers 109B and 109C, but the arrangement of all the transducers 109 in the speaker array 105 remains rotationally and horizontally symmetric.

Figure 10A:
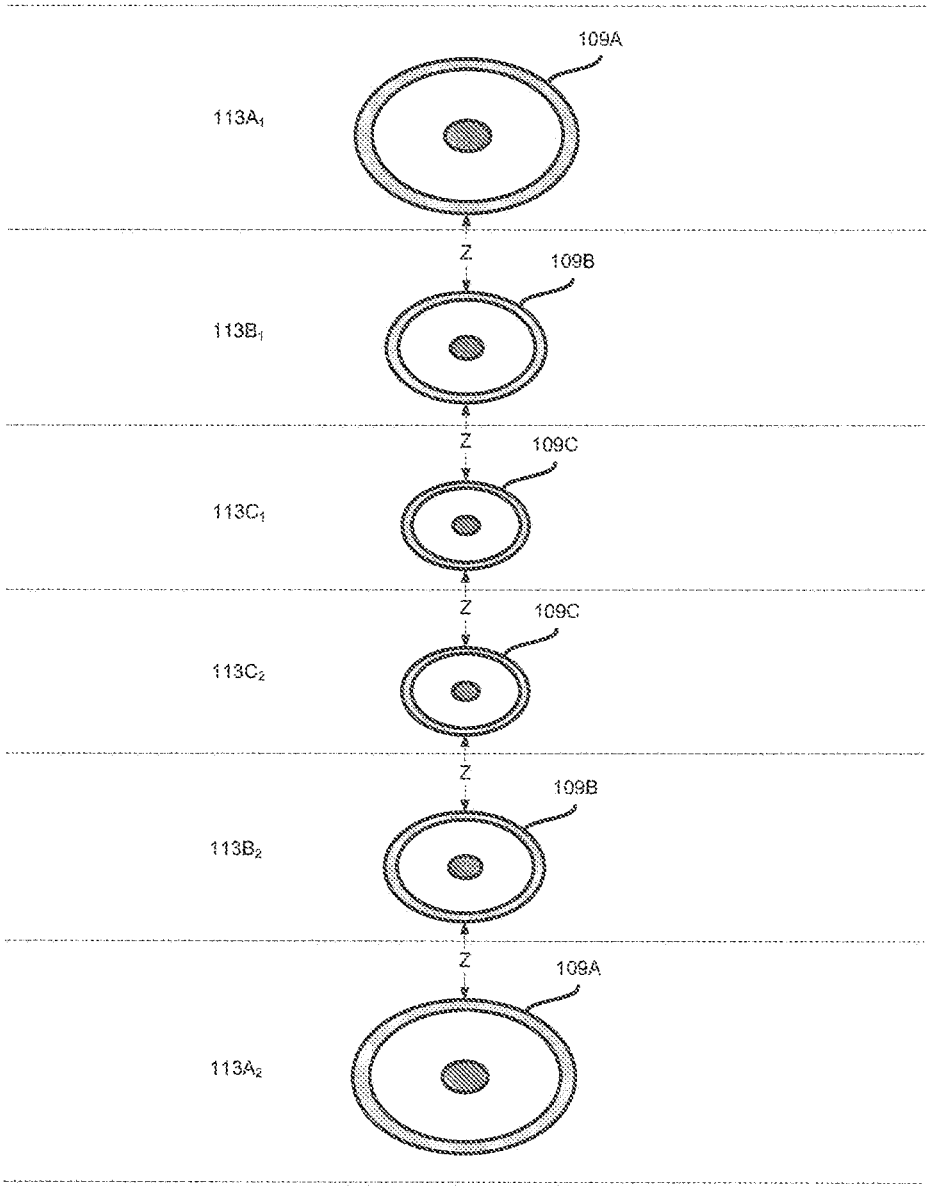
FIG. 10A shows equal spacing amongst rings of transducers according to one embodiment.
Figure 10B:
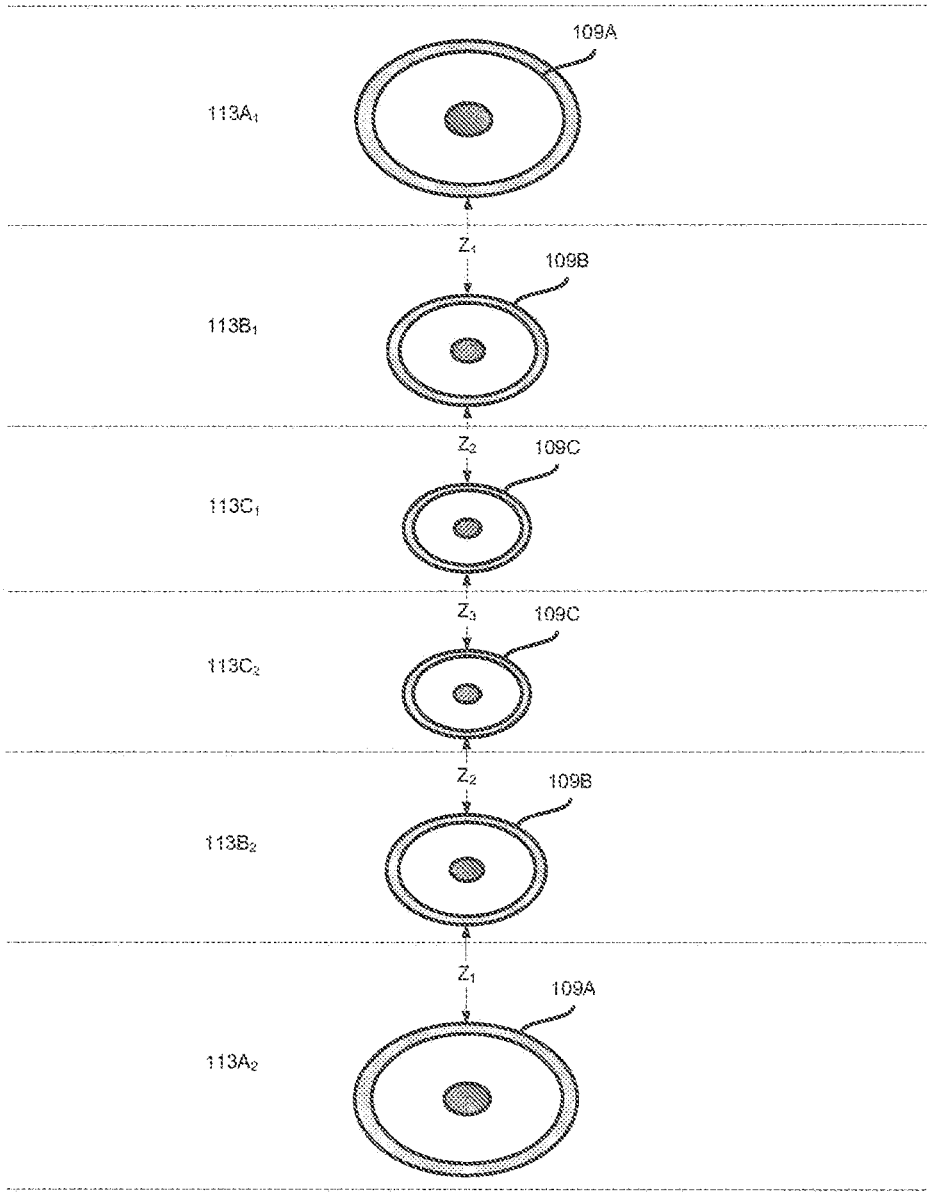
FIG. 10B shows varied spacing amongst rings of transducers according to one embodiment.

In one embodiment, the rings 113 of transducers 109 may be evenly spaced. For example, the outer rims of the transducers 109 in any ring 113 may be separated from the outer rims of any other ring 113 of transducers 109 by the distance Z as shown in the example column 115 of transducers 109 in FIG. 10A. For example, the distance Z may be in the range of 10 mm to 500 mm.

In other embodiments, the spacing between rings 113 of transducers 109 may be varied. For example, in the column 115 shown in FIG. 10H the outer rims of the transducers 109A in the ring 113$A_1$ may be separated from the outer rims of the transducers 109B in the ring 113$B_1$ by the distance $Z_1$ while the outer rims of the transducers 109B in the ring 113$B_1$ may be separated from the outer rims of the transducers 109C in the ring 113$C_1$ by the distance $Z_2$, where $Z_1 \neq Z_2$. Further, the outer rims of the transducers 109C in the ring 113$C_1$ may be separated from the outer rims of the transducers 109C in the ring 132 by the distance $Z_3$, where $Z_1 \neq Z_3$ and/or $Z_2 \neq Z_3$.

Figure 10C:
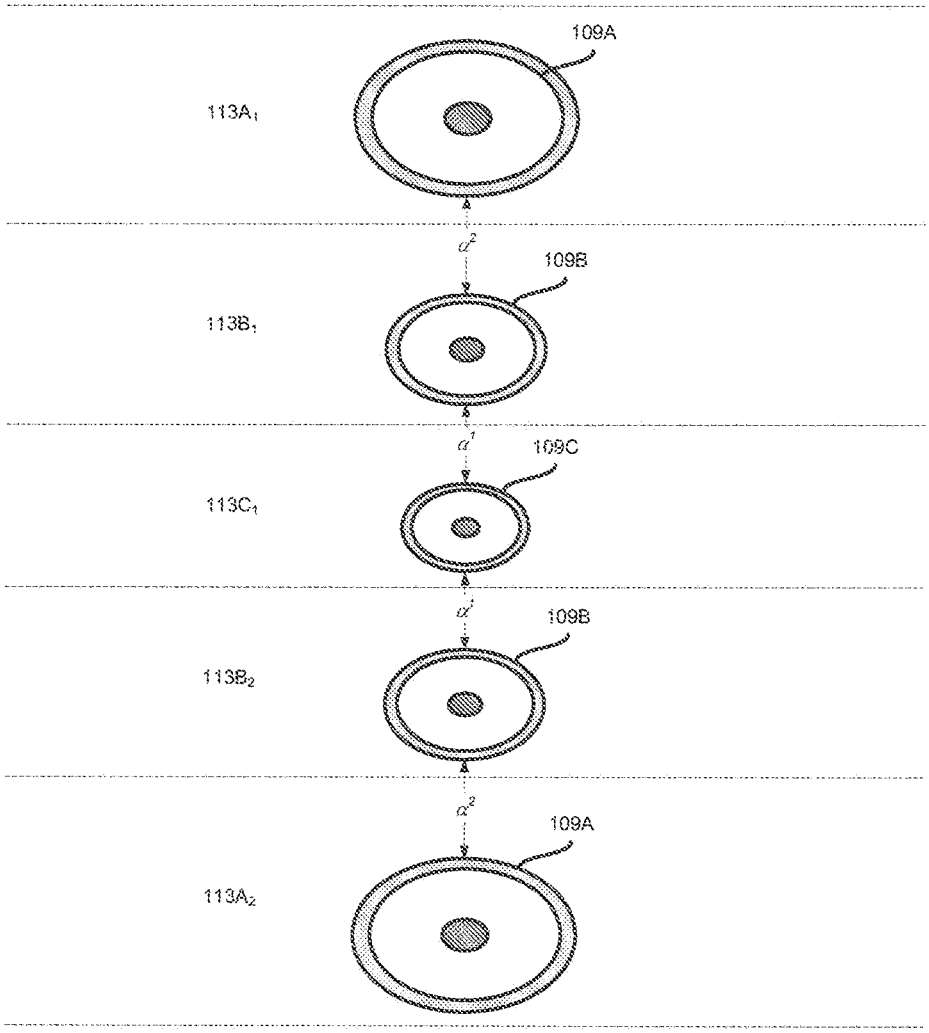
FIG. 10C shows logarithmic spacing amongst rings of transducers according to one embodiment.

In some embodiments, the distance between rings 113 of transducers 109 may be based on a logarithmic scale. For example, as shown in the example column 115 in FIG. 10C, starting from the center-most ring 113 in the speaker array 105 and moving outward along each column in both directions, the distances between each ring 113 may be a logarithmic factor of the distance, where is a real number greater than one. Accordingly, the spacing between each ring 113 may be represented by N, wherein N is an integer greater than or equal to zero. For example, the outer rims of the transducers 109C in the ring 113$C_1$ may be separated from the outer rims of the transducers 109B in the ring 113$B_1$ by the distance 0 the outer rims of the transducers 109B in the ring 113$B_1$ may be separated from the outer rims of the transducers 109A in the ring 113$A_1$ by the distance 1. Similarly, the outer rims of the transducers 109C in the ring 113$C_1$ may be separated from the outer rims of the transducers 109B in the ring 113$B_2$ by the distance land the outer rims of the transducers 109B in the ring 113$B_2$ may be separated from the outer rims of the transducers 109A in the ring 113$A_2$ by the distance 2. By separate rings 113 of transducer 109 using logarithmic spacing, denser transducer 109 spacing at short wavelengths is achieved while limiting the number of transducers 109 needed for longer wavelengths by spacing them in larger and larger logarithmic increments. In one embodiment, the distance H may be in the range of 10 mm to 500 mm.

As noted above, the selection of types of transducers 109 may be made based on desired Frequency coverage for the speaker array 105. In some embodiments, the frequency ranges covered by separate types of transducers 109 may overlap. For example, the transducers 109A may be designed to have frequency coverage between 20 to 200 Hz, the transducers 109B may be designed to have frequency coverage between 100 Hz to 3,000 Hz. and the transducers 109C may be designed to have frequency coverage between 2,000 Hz to 20,000 Hz. Accordingly, in this example the transducers 109B overlap frequency coverage with both the transducers 109A and 109C. In one embodiment, the above frequency limits may correspond to cutoff frequencies for audio crossover filters associated with each transducer 109 in the speaker array 105.

As discussed above, one or more of the transducers 109 in the speaker array 105 may be used to generate one or more beam patterns. For example, one or more of the transducers 109 may be used to generate one or more of the beam patterns shown in FIG. 4. The beam patterns may represent separate channels for a piece of sound program content (e.g., a musical composition or an audio track for a movie).

Figure 11A:
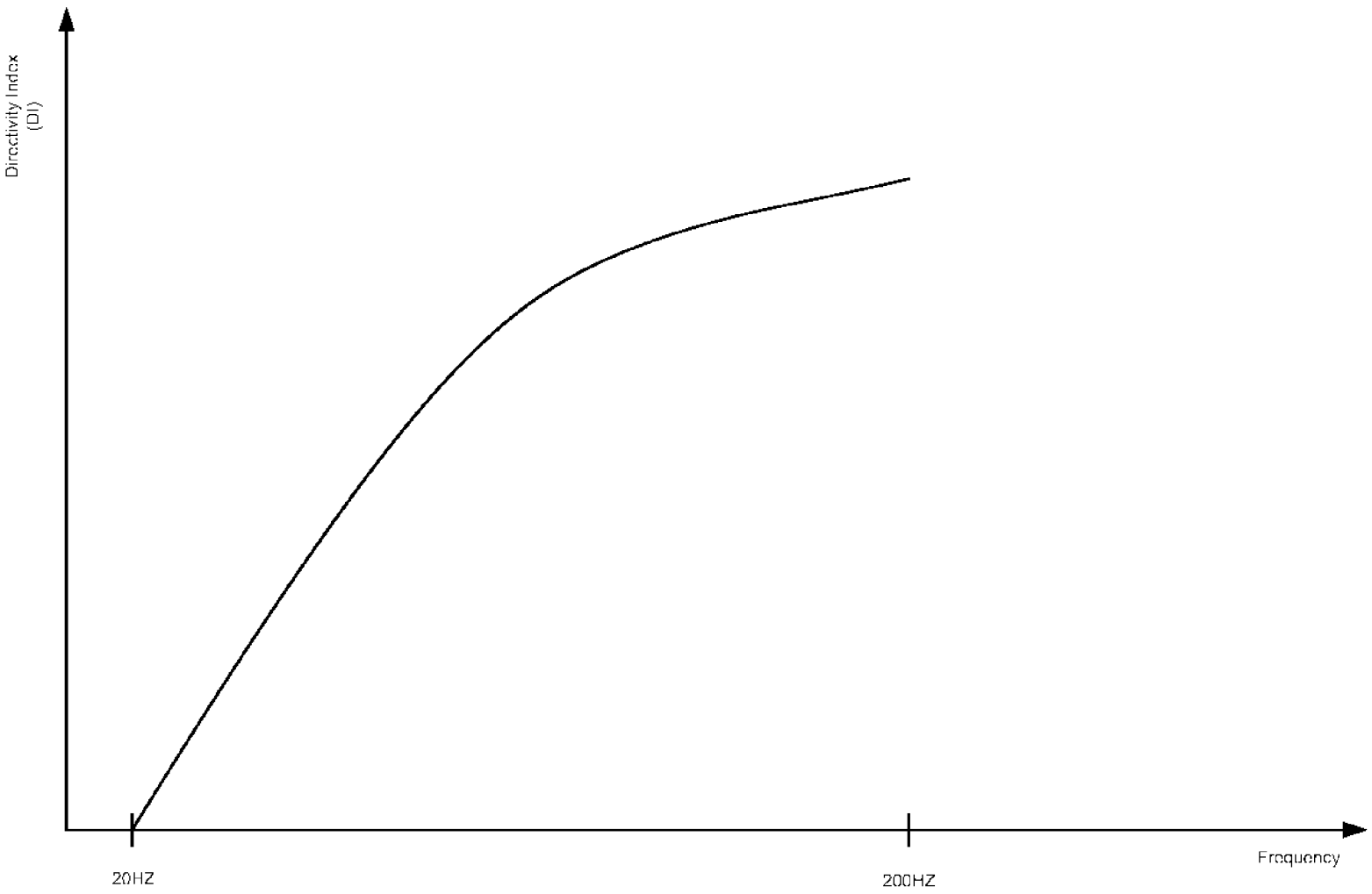
FIG. 11A shows a graph of frequency to directivity for a transducer of a first type according to one embodiment.
Figure 11B:
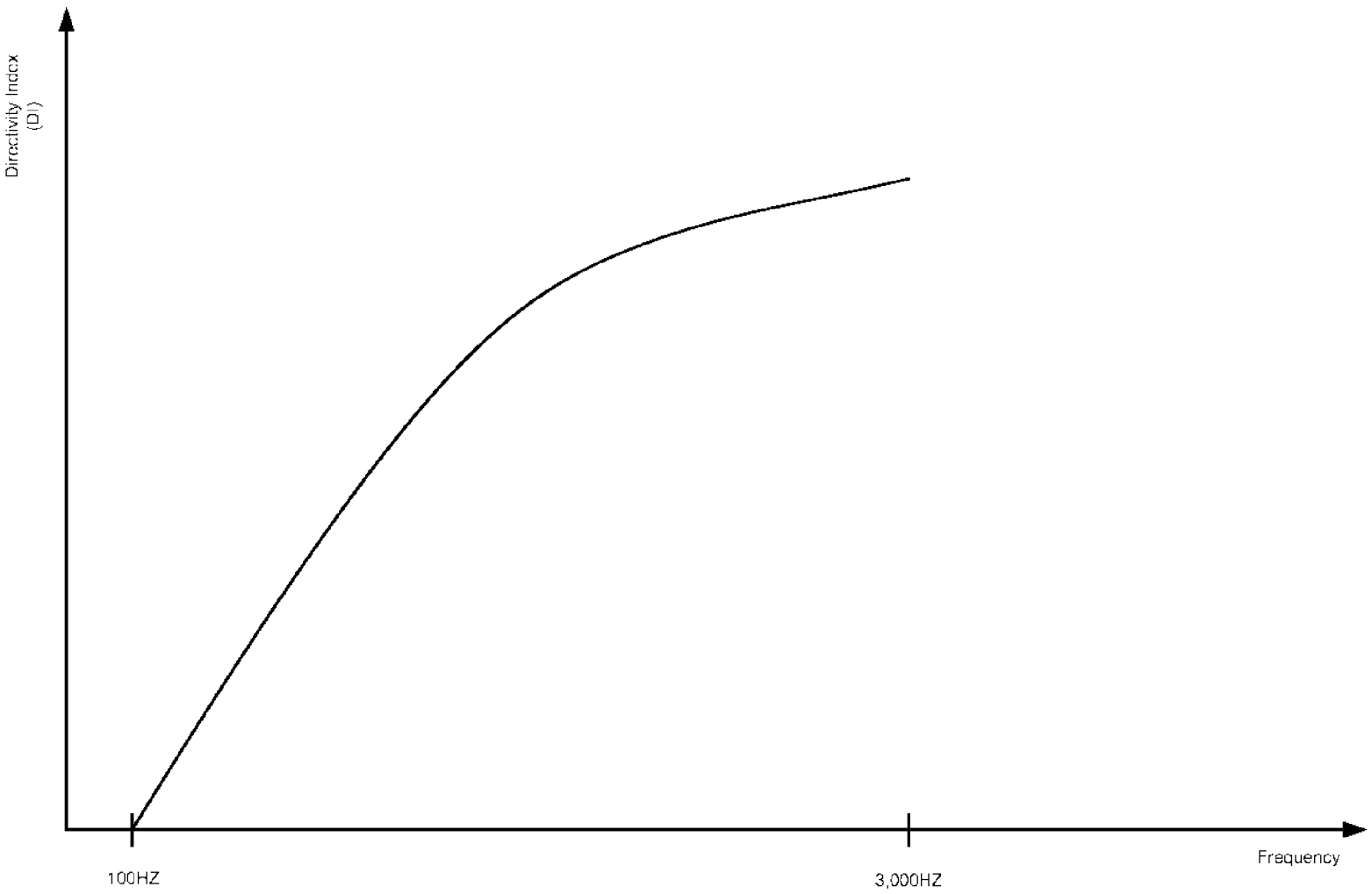
FIG. 11B shows a graph of frequency to directivity for a transducer of a second type according to one embodiment.
Figure 11C:
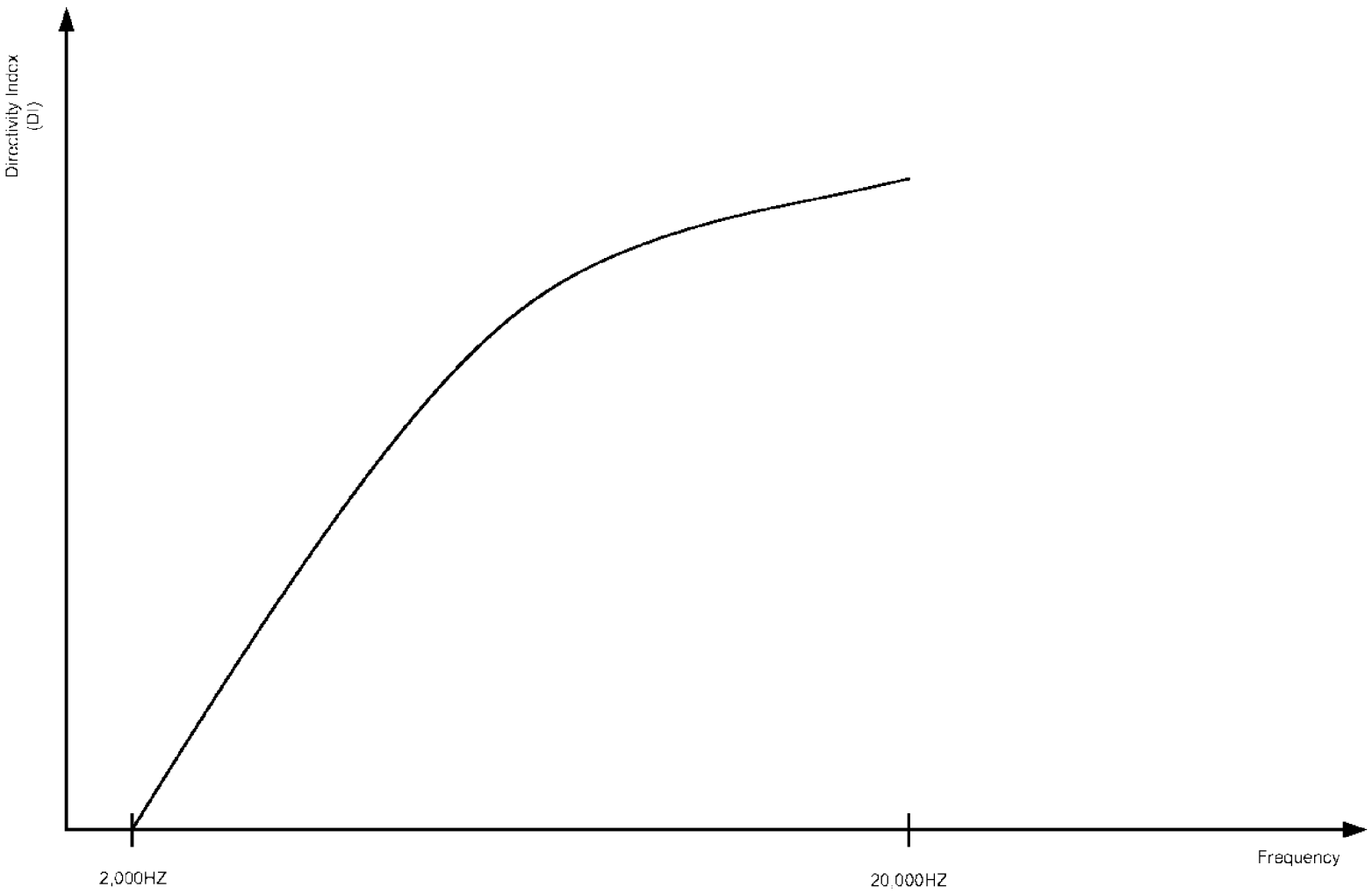
FIG. 11C shows a graph of frequency to directivity for a transducer of a third type according to one embodiment.

As shown in FIGS. 11A-11C, the directivity of a transducer 109 typically rises with the frequency of a drive signal. Accordingly, as shown in FIG. 11A for the transducer 109A, the directivity index at the beginning end of a transducer 109A with the frequency range (e.g., 20 Hz) is low, but the directivity index increases as the frequency of a corresponding signal approaches the far end of the transducer 109A's frequency range (e.g., 200 Hz). Similar behavior can also be seen for the transducers 109B and 109C as shown in FIGS. 11B and 11C, respectively.

Accordingly, based on these initial dips or shortfalls in directivity, blindly/abruptly switching between types of transducers 109 based on signal frequency may result in a poor beam pattern production. Namely, switching from the transducers 109A to the transducers 109B as a signal reaches 100 Hz may generate a low directivity beam pattern as shown in FIG. 11B. Similarly, switching from the transducers 109B to the transducers 109B as a signal reached 2,000 Hz, may generate a low directivity beam pattern as shown in FIG. 11C. When a higher directivity beam pattern is desired, these low directivity beam patterns, which are caused by abrupt switches between transducers 109 of different types, may provide undesirable or unintended sounds.

To overcome these directivity and switching issues, in one embodiment, as described above, the transducers 109 selected for the speaker array 105 have overlapping frequency ranges. In this embodiment, strict switching between transducers 109 of different types may be avoided. Instead, gradual transitions between transducers 109 of different types may be used to generate beam patterns. For example, when a drive signal is used that falls into the frequency overlap between the transducers 109A and 109B (e.g., 100 Hz to 200 Hz), the audio receiver 103 and/or the speaker array 105 may utilize both types of transducers 109A and 109B to produce an associated beam pattern. As the drive signal moves out of the frequency overlap (e.g., above 200 Hz), the audio receiver 103 and/or the speaker array 105 may transition to only utilize the transducers 109B. At this frequency, the transducers 109B may be capable of generating a sufficiently directed beam pattern as shown in FIG. 1B.

Similar transitions may be performed between the transducers 109B and 109C. For example, when a drive signal is used that falls into the frequency overlap between the transducers 109B and 109C (e.g., 2,000 Hz to 3,000 Hz), the audio receiver 103 and/or the speaker array 105 may utilize both types of transducers 109B and 109C to produce an associated beam pattern. As the drive signal moves out of the frequency overlap (e.g., above 3,000 Hz), the audio receiver 103 and/or the speaker array 105 may transition to only utilize the transducers 109C. At this frequency, the transducers 109C may be capable of generating a sufficiently directed beam pattern as shown in FIG. 11C.

As described above, a gradual transition between different types of transducers 109 may be performed based on the frequency of an associated drive signal. This gradual transition may allow the speaker array 105 to produce beam patterns with high directivity indexes, even at the cutoff frequencies of transducers 109. In one embodiment, the transitions am implemented using one or more crossover filters in the speaker array 105 while in other embodiments the transitions are implemented by the audio receiver 103 through the adjustment of beam settings by the hardware processor 201.

As explained above, an embodiment of the invention may be an article of manufacture in which a machine-readable medium (such as microelectronic memory) has stored thereon instructions which program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A speaker array, comprising:

a cabinet having a center axis;

a plurality of first transducers arranged about the center axis at a first vertical location and facing a radial direction;

a plurality of second transducers arranged about the center axis at a second vertical location and facing the radial direction; and a plurality of end transducers at a third vertical location and facing an axial direction;

wherein a first spacing between the first vertical location and the second vertical location in the axial direction is different than a second spacing between the second vertical location and the third vertical location in the axial direction.

2. The speaker array of claim 1 further comprising a plurality of microphones integrated within the speaker array.

3. The speaker array of claim 1, wherein centers of the plurality of second transducers are aligned with centers of the plurality of first transducers.

4. The speaker array of claim 1, wherein the plurality of first transducers is selected to produce audio frequencies in a first frequency range and the plurality of second transducers is selected to produce audio frequencies in a second frequency range.

5. The speaker array of claim 1, wherein a number of the plurality of first transducers is different than a number of the plurality of second transducers, and wherein the plurality of first transducers are evenly spaced about the center axis and the plurality of second transducers are evenly spaced about the center axis such that the speaker array is rotationally symmetric.

6. A speaker array, comprising:

a cabinet having a center axis;

a plurality of transducers arranged about the center axis;

a first end transducer below the plurality of transducers and facing an axial direction; and a plurality of second end transducers at a vertical location above the plurality of transducers and facing the opposite axial direction.

7. The speaker array of claim 6 further comprising a plurality of microphones integrated within the speaker array.

8. The speaker array of claim 6, wherein the first end transducer is a subwoofer facing downward.

9. The speaker array of claim 6, wherein a first vertical spacing between the first end transducer and the plurality of transducers is different than a second vertical spacing between the plurality of transducers and the plurality of second end transducers.

10. The speaker array of claim 9, wherein the first vertical spacing is greater than the second vertical spacing.

11. The speaker array of claim 6, wherein the first end transducer is selected to produce audio frequencies in a first frequency range lower than a second frequency range produced by the plurality of transducers.

12. A speaker array, comprising:

a cabinet having a center axis;

a first plurality of transducers of a first transducer type arranged about the center axis;

a second plurality of transducers of a second transducer type arranged about the center axis, wherein the second plurality of transducers are spaced from the first plurality of transducers in an axial direction of the center axis by a first vertical distance; and a plurality of end transducers of a third transducer type at a vertical location, wherein the plurality of end transducers are spaced from the second plurality of transducers in the axial direction by a second vertical distance different than the first vertical distance.

13. The speaker array of claim 12, wherein the first transducer type has a first frequency range, wherein the second transducer type has a second frequency range, and wherein the third transducer type has a third frequency range.

14. The speaker array of claim 13, wherein the second frequency range is lower than the first frequency range.

15. The speaker array of claim 13, wherein the second vertical distance is greater than the first vertical distance.

16. The speaker array of claim 12, wherein the second plurality of transducers include a plurality of subwoofers.

17. The speaker array of claim 16, wherein the plurality of subwoofers face a radial direction.

18. The speaker array of claim 12, wherein the plurality of end transducers include a subwoofer.

19. The speaker array of claim 18, wherein the subwoofer faces an axial direction.

* * * * *